US011533945B2

(12) United States Patent
Esposti et al.

(10) Patent No.: US 11,533,945 B2
(45) Date of Patent: Dec. 27, 2022

(54) METHOD FOR PRODUCING SMOKING ARTICLES

(71) Applicant: G.D SOCIETA' PER AZIONI, Bologna (IT)

(72) Inventors: Marco Esposti, Casalecchio di Reno (IT); Ivan Eusepi, Castelmaggiore (IT); Massimo Sartoni, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 15/125,211

(22) PCT Filed: Mar. 18, 2015

(86) PCT No.: PCT/IB2015/052000
§ 371 (c)(1),
(2) Date: Sep. 12, 2016

(87) PCT Pub. No.: WO2015/140742
PCT Pub. Date: Sep. 24, 2015

(65) Prior Publication Data

US 2017/0119042 A1 May 4, 2017

(30) Foreign Application Priority Data

Mar. 18, 2014 (IT) ..... BO2014A0136

(51) Int. Cl.
*A24C 5/32* (2006.01)
*A24C 5/47* (2006.01)
*A24D 3/02* (2006.01)

(52) U.S. Cl.
CPC ..... *A24C 5/326* (2013.01); *A24C 5/478* (2013.01); *A24D 3/0287* (2013.01)

(58) Field of Classification Search
CPC ..... A24C 5/326; A24C 5/478; A24C 5/471; A24C 5/32; A24C 5/322; A24C 5/35; A24C 5/14
See application file for complete search history.

(56) References Cited

U.S. PATENT DOCUMENTS 3,228,512 A 1/1966 Rudzinat et al.
4,531,629 A * 7/1985 Seragnoli ..... A24C 5/478 198/458

(Continued)

FOREIGN PATENT DOCUMENTS

DE 10 2011 007 091 A1 10/2012
EP 0 674 853 A2 10/1995

(Continued)

OTHER PUBLICATIONS

International Search Report for International Patent Application No. PCT/IB2015/052000, dated Jul. 22, 2015.

(Continued)

*Primary Examiner* — Alex B Efta
(74) *Attorney, Agent, or Firm* — Marshall, Gerstein & Borun LLP

(57) ABSTRACT

A method for producing smoking articles, in particular cigarettes, each comprising a respective first tobacco rod portion; the method comprises the step of cutting a second rod portion, which is four times the length of the first rod portion, crosswise so as to obtain third rod portions, which are twice the length of the first rod portion; the third rod portions are offset and aligned so as to be fed in succession; the speed at which the third rod portions are conveyed before the offsetting procedure is smaller than the speed at which they are conveyed after the offsetting procedure.

22 Claims, 3 Drawing Sheets

(56) References Cited

U.S. PATENT DOCUMENTS

| | | | | | |
|---|---|---|---|---|---|
| 5,033,482 | A * | 7/1991 | Belvederi | A24C 5/326 | 131/94 |
| 5,666,976 | A * | 9/1997 | Adams | A24F 47/008 | 131/194 |
| 6,736,257 | B2 * | 5/2004 | Steiniger | A24C 5/478 | 198/441 |
| 2002/0043269 | A1 * | 4/2002 | Boldrini | A24C 5/326 | 131/94 |
| 2003/0051978 | A1 * | 3/2003 | Steiniger | A24C 5/478 | 198/459.1 |
| 2003/0234023 | A1 * | 12/2003 | Dombek | A24C 5/475 | 131/88 |

FOREIGN PATENT DOCUMENTS

| | | | | |
|---|---|---|---|---|
| EP | 2 335 503 | A1 | 6/2011 | |
| JP | H11-507234 | A | 6/1999 | |
| JP | 2003-070454 | A | 3/2003 | |
| WO | WO-94/06314 | A1 | 3/1994 | |
| WO | WO-96/39880 | A1 | 12/1996 | |
| WO | WO-2012/168919 | A1 | 12/2012 | |
| WO | WO 2012168919 | A1 * | 12/2012 | A24C 5/471 |

OTHER PUBLICATIONS

Office Action, Japanese Patent Application No. 2016-557274, dated Jan. 8, 2019.

International Preliminary Report on Patentability and Written Opinion, corresponding International Application No. PCT/IB2015/052000, dated Sep. 20, 2016.

* cited by examiner

METHOD FOR PRODUCING SMOKING ARTICLES

CROSS-REFERENCE TO RELATED APPLICATIONS

This is the U.S. National Phase of International Application No. PCT/IB2015/052000, filed Mar. 18, 2015, which claims the benefit of Italian Patent Application No. BO2014A000136, filed Mar. 18, 2014.

TECHNICAL FIELD

The present invention relates to a method for producing smoking articles.

The present invention especially finds advantageous application in the production of cigarettes, to which explicit reference will be made in the description below without loosing in generality because of this.

BACKGROUND OF THE INVENTION

Patent application no. WO2012/168919 described a method for producing cigarettes, each comprising a respective first tobacco rod portion. The method comprises: a first cutting step, during which second rod portions are formed by cutting at least one rod in a first cutting station; a first conveying step, during which the second rod portions are conveyed, crosswise and in succession, from the first cutting station to a second cutting station; and a second cutting step, during which each second rod portion is cut crosswise into two respective first rod portions in the second cutting station. The first rod portions are offset and aligned so as to be fed in succession to a filter assembly machine.

This method involves a high risk of damage to the rod portions. Furthermore, the production rate of the machine is very low, as it is limited by the speed at which the tobacco rod is cut. To this regard, it should be pointed out that the blade carrying out the actual cut is subject to remarkable mechanical stresses, since it must be operated a large number of times per minute.

Problems like these are felt even more strongly when the machine produces small-length cigarettes.

The object of the present invention is to provide a method, which is designed to at least partially eliminate the drawbacks of the prior art and, at the same time, is cheap and easy to carry out.

SUMMARY OF THE INVENTION

According to the present invention, there are provided a machine and a method for producing cigarette filters, as claimed in the accompanying independent Claim and, preferably, in any one of the Claims that directly or indirectly depend on the aforesaid independent Claim.

BRIEF DESCRIPTION OF THE DRAWINGS

The present invention will now be described with reference to the accompanying drawings, which show a non-limiting embodiment thereof, wherein.

DETAILED DESCRIPTION OF THE INVENTION

Figures 1, 2:
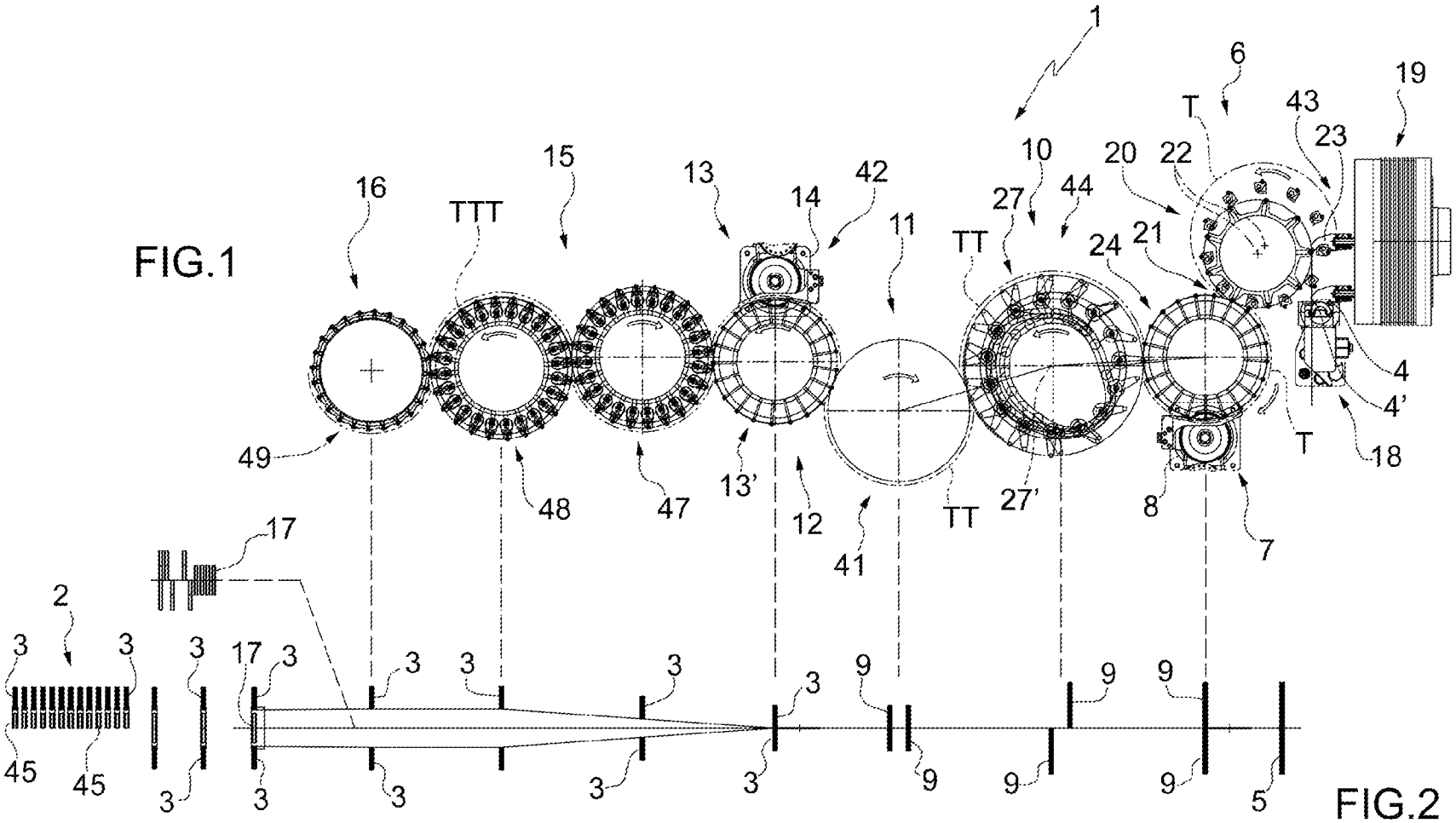
FIG. 1 is a lateral, schematic view, with some details removed for greater clarity, of a machine to implement a method according to the present invention.
FIG. 2 shows the different processing steps taking place in the machine of FIG. 1.

In FIG. 1, number 1 indicates, as a whole, a machine for manufacturing smoking articles 2 (with a substantially cylindrical shape) (FIG. 2), each comprising a rod portion 3.

According to some embodiments, the smoking articles 2 are cigarette filters. According to alternative and preferred embodiments, the smoking articles 2 are cigarettes.

The description below, which relates to the production of cigarettes, also applies mutatis mutandis (and as far as possible) to filters instead of cigarettes. It should be pointed out that, for example, in order to produce cigarette filters, filter rods are used instead of tobacco rods.

The machine 1 comprises a cutting device (of a known type and not shown) to cut a tobacco rod 4 crosswise (relative to its longitudinal extension), so as to obtain tobacco rod portions 5 (see FIG. 2); a conveying system 6 to convey the rod portions 5 to a cutting station 7; and a cutting device 8, which is located in the cutting station 7, so as to cut the rod portions 5 crosswise (relative to their longitudinal extension) and obtain tobacco rod portions 9.

The tobacco rod 4 has an oblong shape (substantially cylindrical) and normally consists of a strand of tobacco wrapped in a strip of paper.

The machine 1 comprises, furthermore, an offsetting device to move the rod portions 9 cut from the same rod portion 5 crosswise (relative to their longitudinal extension) with respect to one another and an aligning device 11 to cause the rod portions 9 to be arranged in succession.

According to the embodiment shown in the figures, a conveying device 12 is provided for conveying the rod portions 9 to a cutting station 13.

A cutting device 14 is located in the area of the cutting station 13 so as to cut the rod portions 9 crosswise and obtain the rod portions 3.

The machine 1 comprises, furthermore, a parting device 15 to longitudinally move the (two) rod portions 3 cut from the same rod portion 9, and an insertion device 16 (of a known type and only partially shown) to insert a double filter portion 17 into the space that was created.

In use, the filter portions 17 are subsequently connected to the relative rod portions 3 and cut crosswise (and in the middle) so as to obtain the cigarettes 2.

According to the embodiment shown in FIG. 1, the machine 1 comprises, furthermore, a feeding assembly 18 to feed the tobacco rod 4 longitudinally in a given direction (substantially perpendicular to the sheet plane of FIG. 1). In particular, the feeding assembly 18 is designed to feed two tobacco rods 4, 4', which, in use, are both cut crosswise to obtain the rod portions 5.

In particular, the conveying system 6 comprises a transfer device 19, which is designed to pick up (substantially simultaneously) a rod portion 5 cut from the tobacco rod 4 and a rod portion 5 cut from the tobacco rod 4' and to feed each of them to a seat of a respective transfer wheel 20 (of the conveying system 6 itself). The two transfer wheels 20 are designed to receive the respective rod portions 5 in different locations and to carry them to the same unloading location 21. Each transfer wheel 20 has an axis of rotation 22 that is parallel to and offset with respect to the axis of rotation 22 of the other transfer wheel 20. Advantageously, the two transfer wheels 20 have different diameters.

The transfer device 19 comprises a plurality of pick-up assemblies 23, each having two pick-up seats that are integral to one another. Each pick-up seat is designed to house a respective rod portion 5.

The machine 1 comprises, furthermore, a wheel 24 to convey the rod portions 5 from the location 21 to the cutting station 7. In particular, the wheel 24 comprises a plurality of peripheral wheels 25, each designed to carry two rod portions 9 cut from the same rod portion 5 (by means of the cutting device 14) to a transfer location 26.

Figure 3:
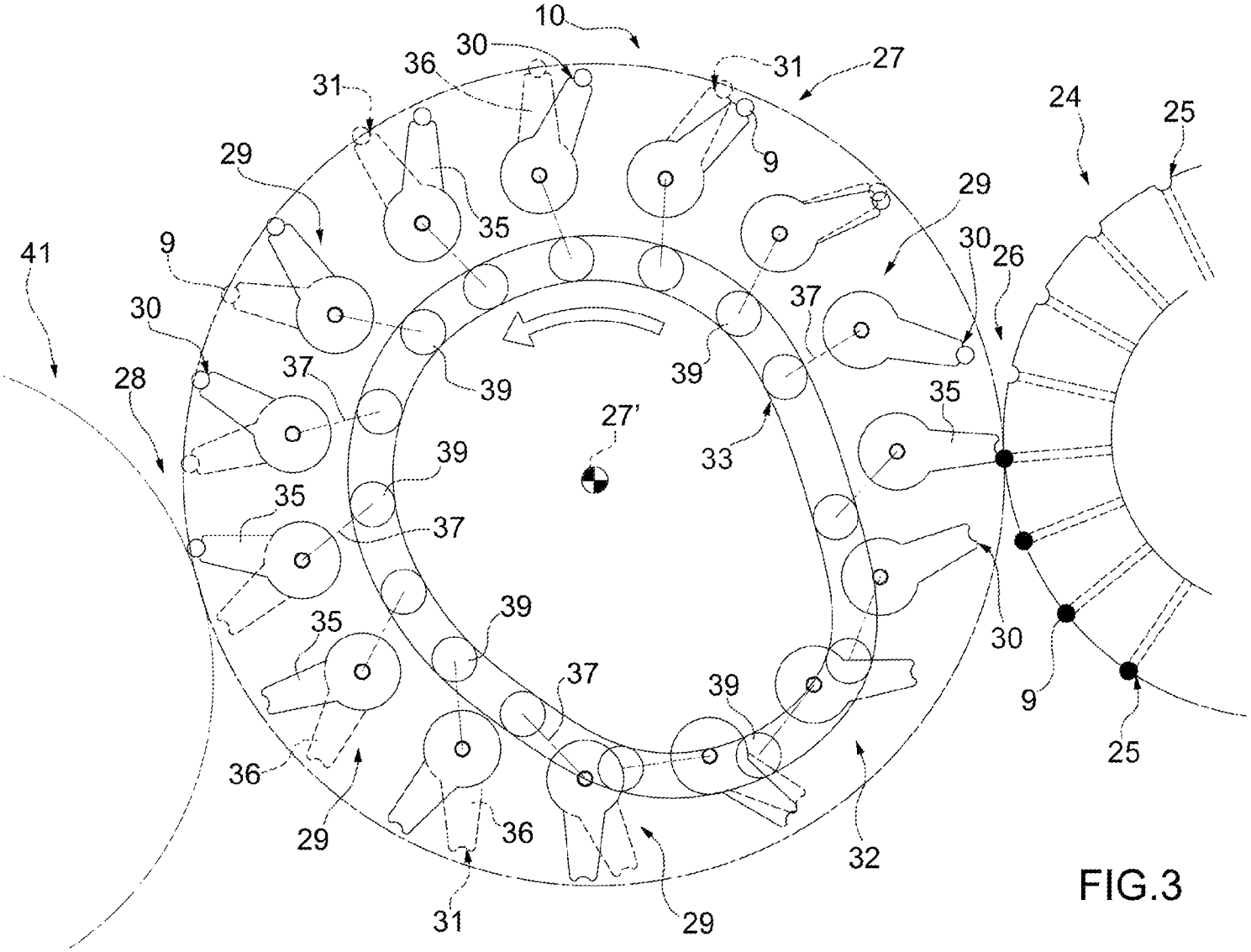
FIG. 3 shows a part of the machine of FIG. 1, on a larger scale and with some details removed for greater clarity.
Figure 4:
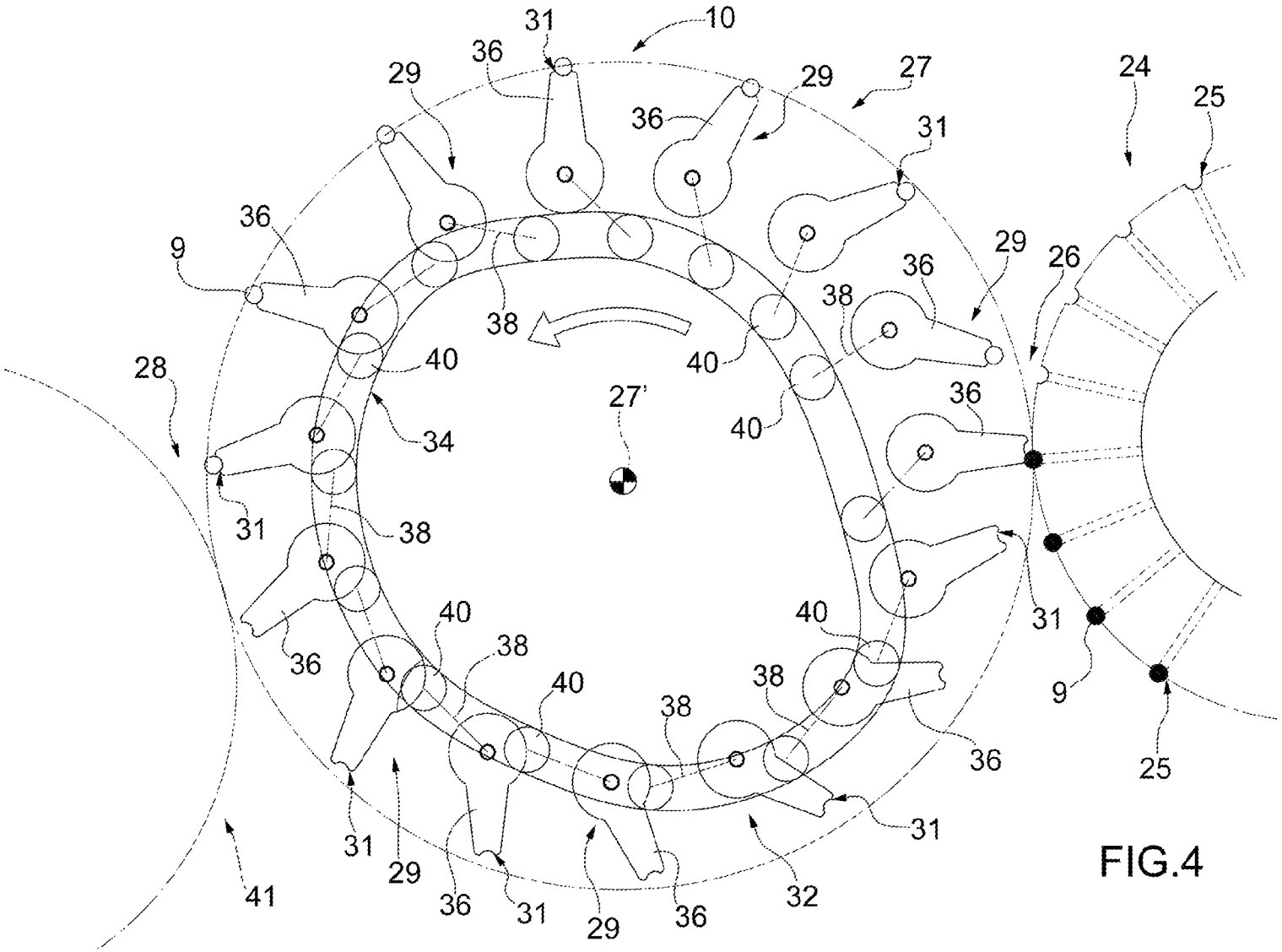
FIG. 4 shows the part of FIG. 3 with different elements pointed out.

With particular reference to FIGS. 3 and 4, the offsetting device 10 advantageously comprises a wheel 27, which is designed to receive the rod portions 5 in the location 26 and to carry them (by rotating about its own axis 27' of rotation) to a transfer location 28.

In particular, the wheel 27 comprises a plurality of pick-up assemblies 29, each of which receives two rod portions 9, cut from the same rod portion 5, from the wheel 24 in the location 26, parts the two rod portions 9 cut from the same rod portion 5, and then releases the rod portions 9 one after the in the location 28.

More precisely, each pick-up assembly 29 comprises two seats 30 and 31, each designed to house a respective rod portion 9. The seats 30 and 31 of the same pick-up assembly 29 are coupled in the location 26, and are parted as they move towards the location 28. In particular, the wheel 27 comprises a cam system 32 to move (more in particular, to change the orientation of) the seats 30 and 31 with respect to one another, as the wheel 27 rotates about its own axis 27'.

According to some embodiments, the cam system 32 comprises two guide cams 33 and 34, which have respective paths that are at least partially different. Each pick-up assembly 29 comprises two supporting arms 35 and 36, which are mounted so as to rotate about the same axis and each support a respective seat 30, 31.

Each pick-up assembly 29 also comprises two connecting arms 37 and 38, each integral to a respective supporting arm 35 and 36 and connected to a relative slide 39 and 40 (tappet), which is movable along a respective guide cam 33 and 34.

It should be pointed out that FIG. 3 shows the arms 35 and 37, the slide 39 and the cam 33; the arms 36 are drawn only with a broken line. FIG. 4 shows the arms 36 and 38, the slide 40 and the cam 34.

In use, as the second wheel 27 rotates, the movement of the slides 39 and 40 of each pick-up assembly 29 along the two different guide cams 33 and 34 produces a relative rotation of the two supporting arms 37 and and, therefore, a relative movement of the seats 30 and 31 (see, in particular, FIG. 4). More precisely, as the pick-up assembly 29 moves from the location 26 to the location 28, the seats 30 and 31 move apart from one another; as the pick-up assembly 29 moves from the location 28 to the location 26, the seats 30 and 31 move close to one another.

The wheel 27 allows operators to obtain the offset of the rod portions 9 in an easy and efficient manner, thus reducing the risk of damage to the rod portions 9 themselves.

As the wheel 27 rotates, the orientation of the seats and 31 in the location 26 is altered so as to prolong the length of time for which the first seats 30 and 31 remain facing the seats 25. This makes it easier for the rod portion 9 to be transferred from the wheel 24 to the wheel 27, thus reducing at the same time the risk of damage to the rod portions 9 themselves.

The machine 1 comprises, furthermore, a wheel 41, which receives the rod portions 9 from the wheel 27 (in the area of location 28) and is designed to convey the rod portions 9 towards the cutting station 13. According to some embodiments, the wheel 41 is of a known type and acts also as an aligning device 11.

For example, fixed guides are provided, which are located along the perimeter of the wheel 41 so as to move the rod portions longitudinally as the wheel rotates.

In order to better understand how the machine 1 works, FIG. 2 shows the different processing steps that are carried out by corresponding different parts of the machine, with reference to the portions 3, 5, 9, 17 and 45. In particular, the different steps shown in FIG. 2 are carried out by the parts of the machine shown in a corresponding location above the steps themselves.

According to an aspect of the present invention, there is provided a method for producing smoking articles 2, each comprising a first rod portion 3. Preferably, the smoking articles 2 are cigarettes, each comprising a respective first tobacco rod portion 3.

Advantageously, the method is implemented by the machine 1 described above.

The method comprises: a first cutting step, during which second rod portions 5 are formed by cutting at least one rod 4 in a first cutting station 43. Each rod portion 5 is a multiple in length of the rod portion 3.

The method also comprises a first conveying step, during which the rod portions 5 are conveyed crosswise (relative to their longitudinal extension) and in succession from the cutting station 43, along a first portion T of a given path, to a further cutting station 7; and a second cutting step, during which each rod portion 5 is cut crosswise into at least two respective rod portions 9 in the cutting station 7. Each rod portion 9 is a multiple in length of said rod portion 3.

Furthermore, the method comprises a second conveying step, during which the rod portions 9 are conveyed crosswise along a second portion TT of the given path from the cutting station 7, so as to arrive one at a time and in succession at an output station 42; and an offsetting step, during which the two rod portions 9 cut from the same rod portion 5 are moved crosswise and with respect to each other, so as to be offset with respect to each other, in an offsetting station (where the offsetting device 10 is located), which is located along the second path portion TT.

According to some embodiments, the rod portions 9 are fed along the second path portion TT to the offsetting station 43 at a smaller speed than the one at which the rod portions 9 are fed along the second path portion TT from the offsetting station 44, in particular to the output station 42.

In this way, the machine can ensure a high production rate 2 reducing the risk of damage to the rod portions 9.

Advantageously, the rod portions 5 are fed to the cutting station 7 at a smaller speed than the one at which the rod portions 9 are conveyed along the second path portion TT from the offsetting station 44, in particular to the output station 42.

By so doing, the risk of damage to the rod portions 5, which are especially delicate as they are relatively long, is reduced.

According to some embodiments, the rod portions 9 are conveyed along the second path portion TT from the cutting station 7 to the offsetting station 44, so that the spacing between the rod portions 9 cut from successive rod portions 5 is less than twice the spacing at which successive rod portions 9 are conveyed along the second path portion TT downstream from the offsetting station 44 (in particular, to the output station 42).

In particular, the rod portions 5 are conveyed to the cutting station 7 so that the spacing (distance) between successive rod portions 5 is less than twice the spacing (distance) at which successive rod portions 9 are conveyed along the second path portion TT downstream from the offsetting station 44 (in particular, to the output station 42).

According to some advantageous embodiments, the rod portions 9 are conveyed along the second path portion TT from the cutting station 7 to the offsetting station 44, so that the spacing between the rod portions 9 cut from successive rod portions 5 is less than or substantially equal to (in particular, substantially equal to) the spacing at which successive third rod portions 9 are conveyed along the second path portion TT downstream from the offsetting station 44 (in particular, to the output station 42).

In particular, the rod portions 5 are conveyed to the cutting station 7 so that the spacing between successive rod portions 5 is less than or substantially equal to (in particular, substantially equal to) the spacing at which successive third rod portions 9 are conveyed along the second path portion TT downstream from the offsetting station 44 (in particular, to the output station 42).

In this way, the speed at which the rod portions 5 and 9 are conveyed downstream from the offsetting station 44 can be reduced in an easy and inexpensive manner. Furthermore, by so doing, one can have parts of the machine 1 that are compatible upstream and downstream of the offsetting station 44. This simplifies and reduces the costs to manage the spare parts of the machine 1.

In particular, the rod portions 5 are the same length. The rod portions 9 are the same length. More precisely, each rod portion 9 is substantially half the length of each rod portion 5.

In particular, each rod portion 5 is four times the length of the rod portion 3. More precisely, each rod portion 9 is twice the length of the rod portion 3. According to some embodiments, the method comprises a third cutting step, during which the rod portions 9 are cut into said rod portions 3 in the output station 42 (which, in particular, corresponds to the cutting station 13).

More precisely, the rod portions 9 are fed to the cutting station 13 and the rod portions 3 are conveyed to the cutting station 13 by means of a wheel 13' (of the conveying system 12).

In some cases, the method comprises a parting step, during which the rod portions 3 cut from the same rod portion 9 are parted longitudinally.

According to some embodiments, each cigarette 2 comprises a filter portion 45. In these cases, the method also comprises an insertion step, which takes place after the parting step and during which a double filter portion 17 or two filter portions 45 is/are inserted between the two parted rod portions 3.

According to the embodiment shown, the parting step is implemented by two wheels 47 and 48; the insertion step is implemented as the rod portions 3 are transported by the wheel 49 of an insertion device 16 (of a known type and only partially shown). The wheels 13', 47, 48 and 49 are also designed to convey the rod portions 3 along a third portion TTT of the aforesaid given path.

Advantageously, the method comprises, furthermore, an aligning step, during which the rod portions 9 cut from the same rod portion 5 are moved longitudinally and with respect to each other in an aligning station located along the second path portion TT, downstream from the offsetting station 44 (so as to be arranged in succession along the path portion TT).

According to some embodiments, during the first cutting step, the rod portions 5 are formed by cutting said tobacco rod 4 and a further tobacco rod 4'. The rod portions 5 are fed to the cutting station 7 in such a way that each rod portion 5 cut from the rod 4 is followed by a rod portion 5 cut from the further rod 4' and vice versa.

In particular, during the first conveying step, a rod portion 5 cut from the rod 4 and a rod portion 5 cut from the further rod 4' are picked up substantially simultaneously by two integral pick-up seats, and are each fed to a seat on a respective transfer wheel 20. Advantageously, the two transfer wheels 20 are designed to receive the respective rod portions 5 in different locations and to carry them to the same unloading location 21.

More precisely, each transfer wheel 20 has an axis of rotation 22 that is parallel to and offset with respect to the axis of rotation 22 of the other transfer wheel 20. Advantageously, the two transfer wheels 20 have different diameters.

According to some embodiments, the rod portions 9 are fed to the offsetting station 44 by a first wheel 24. In particular, the wheel 24 receives the rod portions 5 from the transfer wheels 20 in the location 21 (and feeds them to the offsetting station 44).

A wheel 27 is located in the offsetting station 44 to receive the rod portions 9 from the wheel 24 and to transfer them to a wheel 41, which conveys the rod portions 9 along at least part of the second path portion TT.

In particular, the wheel 27 comprises a number of pick-up assemblies 29, each of which receives two rod portions 9, cut from the same rod portion 5, from the first wheel 24 in a transfer location 26, parts the two rod portions 9 cut from the same rod portion 5, and then releases said rod portions 9 one after the other to the wheel 41 in a second transfer location 28.

Advantageously, the wheels 24, 27 and 41 are defined and work in accordance with the above description of the machine 1.

According to some embodiments, each rod portion 9 rotates over 180° about the axis of rotation 27' of the wheel 27 to move from the location 26 to the location 28.

The invention claimed is:

1. A method for producing smoking articles, each comprising a first rod portion; the method comprising:

a first cutting step, during which second rod portions are formed by cutting at least one rod in a first cutting station; each second rod portion being a multiple in length of said first rod portion;

a first conveying step, during which each of the second rod portions is conveyed crosswise and in succession from the first cutting station along a first portion of a given path to a second cutting station;

a second cutting step, during which each second rod portion is cut crosswise into at least two third rod portions in the second cutting station; each third rod portion being a multiple in length of the first rod portion, wherein the at least two third rod portions are aligned longitudinally with respect to one another;

a second conveying step including an offsetting step, during which each of the third rod portions is conveyed crosswise along a second portion of the given path from the second cutting station so as to arrive one at a time and in succession at an output station;

wherein during the offsetting step the at least two third rod portions cut from the same second rod portion are moved from the longitudinal alignment crosswise and with respect to each other, so as to be taken out of longitudinal alignment with respect to each other, in an offsetting station located along the second path portion;

each of the third rod portions when in longitudinal alignment is fed along the second path portion to the offsetting station at a slower speed than a speed at which each of the third rod portions after being arranged so as to be taken out of longitudinal alignment is fed along the second path portion directly from the offsetting station to a station immediately adjacent the offsetting station, wherein, during the first conveying step, each of the second rod portions is conveyed to the second cutting station by a first wheel, and during the second conveying step, each of the third rod portions is received directly from the first wheel by a second wheel at a first transfer location, the second wheel is located at the offsetting station and carries out the offsetting step, at least two third rod portions are received at a second transfer location one at a time in succession at the output station from the second wheel, and said at least two third rod portions are moved from the longitudinal alignment crosswise and with respect to each other, so as to be taken out of longitudinal alignment with respect to each other, during a majority of a movement from the first transfer location to the second transfer location and as said at least two third rod portions are on the second wheel.

2. The method according to claim 1, wherein each of the second rod portions is fed to the second cutting station at a slower speed than a speed at which each of the third rod portions is conveyed along the second path portion from the offsetting station.

3. The method according to claim 1, wherein each of the third rod portions is conveyed along the second path portion from the second cutting station to the offsetting station, so that a spacing between each of the third rod portions cut from each of the successive second rod portions is less than twice a spacing at which each of the successive third rod portions are conveyed along the second path portion downstream from the offsetting station.

4. The method according to claim 3, wherein each of the third rod portions are conveyed along the second path portion from the second cutting station to the offsetting station, so that a spacing between the each of the third rod portions cut from each of the successive second rod portions is less than or substantially equal to a spacing at which each of the successive third rod portions are conveyed along the second path portion downstream from the offsetting station.

5. The method according to claim 1, wherein each of the second rod portions is the same length; each of the third rod portions is the same length.

6. The method according to claim 1, wherein each second rod portion is four times the length of the first rod portion; and each third rod portion is twice the length of the first rod portion.

7. The method according to claim 1, further comprising a third cutting step, during which the at least two third rod portions are cut into said first rod portions in the output station.

8. The method according to claim 7, wherein each smoking article is a cigarette comprising a filter portion; the method further comprising:

a parting step, during which the first rod portions cut from the same third rod portion are parted longitudinally; and an insertion step, which takes place after the parting step and during which a double filter portion or two filter portions is/are inserted between the two parted first rod portions.

9. The method according to claim 1, further comprising an aligning step, during which the at least two third rod portions cut from the same second rod portion are moved longitudinally and with respect to each other in an aligning station located along the second path portion, downstream from the offsetting station.

10. The method according to claim 1, wherein, during the first cutting step, the second rod portions are formed by cutting said rod and a further rod; the second rod portions being fed to the second cutting station, so that each second rod portion cut from the rod is followed by a second rod portion cut from the further rod and vice versa.

11. The method according to claim 10, wherein, during the first conveying step, a second rod portion cut from the rod, and a second rod portion cut from the further rod are picked up substantially simultaneously by two integral pick-up seats, and are each fed to a seat on a respective transfer wheel; the two transfer wheels being designed to receive the respective second rod portions in different locations, and to carry them to a same unloading location.

12. The method according to claim 11, wherein each one of the transfer wheels has an axis of rotation parallel to and offset with respect to the axis of rotation of the other transfer wheel; the two transfer wheels having different diameters.

13. The method according to claim 1, wherein the second wheel being located in the offsetting station transfers each of the third rod portions to a third wheel, which conveys each of the third rod portions along at least part of said second path portion; the second wheel comprising a number of pick-up assemblies, each of which receives the at least two third rod portions, cut from the same second rod portion, from the first wheel in a first transfer location, parts the at least two third rod portions cut from the same second rod portion, and then releases said at least two third rod portions one after the other to the third wheel in a second transfer location.

14. The method according to claim 13, wherein each pick-up assembly comprises two first seats, each designed to house a respective third rod portion; the first seats of the same pick-up assembly being coupled in the first transfer location, and being parted as they move towards the second transfer location.

15. The method according to claim 14, wherein the second wheel comprises a cam system, the cam system comprises two guide cams having respective paths that are at least partly different; each pick-up assembly comprises two supporting arms mounted so as to rotate about the same axis and each supporting a respective first seat, and two connecting arms, each integral to a respective supporting arm and connected to a relative slide movable along a respective guide cam; and, as the second wheel rotates, the movement of the slides of each pick-up assembly along the two different guide cams produces a relative rotation of the two supporting arms and, therefore, a relative movement of the first seats of the pick-up assembly.

16. The method according to claim 14, wherein the first wheel comprises a number of peripheral second seats, each designed to carry two third rod portions, cut from the same second rod portion, to the first transfer location; and, as the second wheel rotates, the orientation of the first seats in the first transfer location is altered to prolong the length of time the first seats remain facing one of the second seats.

17. The method according to claim 13, wherein each third rod portion rotates over 180° about the axis of rotation of the second wheel to move from the first transfer location to the second transfer location.

18. A method for producing smoking articles, each comprising a first rod portion; the method comprising:

cutting at least one rod in a first cutting station into second rod portions, each second portion being a multiple in length of the first rod portion;

conveying the second rod portions from the first cutting station along a first portion of a transport path to a second cutting station by a first wheel;

cutting at the second cutting station the second rod portions crosswise into at least two third rod portions, each third rod portion being a multiple in length of the first rod portion;

conveying the at least two third rod portions along a second portion of the transport path from the second cutting station to so as to arrive one at a time and in succession at an output station, wherein each of the at least two third rod portions is received directly from the first wheel by a second wheel at a first transfer location, the second wheel being located at an offsetting station disposed along the second portion of the transport path between the second cutting station and the output station and the at least two third rod portions are received at a second transfer location one at a time in succession at the output station from the second wheel, and wherein:

the second wheel comprises a plurality of pick-up assemblies, each pick-up assembly comprising two support arms, each supporting arm comprising a respective seat, when conveyed from the first wheel at the second cutting station to the second wheel at the offsetting station the at least two third rod portions are received by the pick-up assembly in the respective seat of the at least two support arms and aligned longitudinally; and the plurality of pick-up assemblies rotate around the second wheel after receiving the at least two third rod portions from the first wheel and upon rotation away from the first transfer location, the two support arms of each of the plurality of pick-up assemblies move apart from one another during a majority of the rotation from the first transfer location to the second transfer location, such that the at least two third rod portions are moved from the longitudinal alignment crosswise with respect to each other so as to be offset with respect to each other so as not to be aligned longitudinally; wherein each of the third rod portions is accelerated in the offsetting station such that each of the third rod portions is fed to the offsetting station at a slower speed than a speed at which each of the third rod portions is fed from the offsetting station to a station immediately adjacent to the offsetting station.

19. The method of claim 18, wherein the offsetting station comprises a wheel that rotates about an axis, the at least two third rod portions aligned longitudinally are received on the wheel at a receiving position from the second cutting station and rotated by the wheel to a discharge position, the at least two third rod portions are moved crosswise with respect to each other so as to be offset during rotation from the receiving position to the discharge position, and each of the third rod portions is fed to the wheel at a slower speed than a speed at which each of the third rod portions is fed from the wheel at the discharge position.

20. The method of claim 1, wherein the offsetting station comprises a wheel that rotates about an axis, the at least two third rod portions aligned longitudinally are received on the wheel at a receiving position from the second cutting station and rotated by the wheel to a discharge position, the at least two third rod portions are moved crosswise with respect to each other so as to be offset during rotation from the receiving position to the discharge position, and each of the third rod portions is fed to the wheel at a slower speed than a speed at which each of the third rod portions is fed from the wheel at the discharge position.

21. The method of claim 1, wherein the station immediately adjacent the offsetting station comprises a third wheel and during the second conveying step the third wheel, which act as an aligning device, receives the third portions from the second wheel, aligns transversely the third rod portions so as to convey third rod portions in succession one after the other along at least part of the second portion of the given path at the second speed.

22. The method of claim 18, wherein the station immediately adjacent the offsetting station comprises a third wheel and during the second conveying step a third wheel, which act as an aligning device, receives the third portions from the second wheel, aligns transversely the third rod portions so as to convey third rod portions in succession one after the other along at least part of the second portion of the given path at the second speed.

* * * * *